United States Patent [19]

Richards

[11] 4,290,198

[45] Sep. 22, 1981

[54] ICE BREAKER

[75] Inventor: Robert A. Richards, North Adams, Mass.

[73] Assignee: Janice M. B. Richards, North Adams, Mass. ; a part interest

[21] Appl. No.: 138,180

[22] Filed: Apr. 7, 1980

[51] Int. Cl.[3] ..... E01H 5/12

[52] U.S. Cl. ..... 30/164.5; 294/49

[58] Field of Search ..... 30/136.5, 164.5, 164.6, 30/164.8; 294/49, 54, 55

[56] References Cited

U.S. PATENT DOCUMENTS

| | | | |
|---|---|---|---|
| 1,233,673 | 7/1917 | Kinney | 30/164.5 X |
| 1,435,061 | 11/1922 | Halsey | 30/164.5 X |
| 1,714,592 | 5/1929 | Denning | 294/49 |
| 2,397,571 | 4/1946 | Sveda | 30/164.5 |
| 2,649,604 | 8/1953 | Hess | 30/136.5 X |
| 3,848,915 | 11/1974 | Wherry | 294/49 |

*Primary Examiner*—Jimmy C. Peters

*Attorney, Agent, or Firm*—Ross, Ross & Flavin

[57] ABSTRACT

A tool for chopping and scraping ice distinguished by a pair of arcuate portions which extend rearwardly from opposite edges of a straight sided intermediate portion which provides the chopping and scraping function, with the lower edges of the arcuate portions serving to pressurize the ice or mud and to force it forwardly in the direction of the straight sided intermediate portion.

1 Claim, 4 Drawing Figures

ICE BREAKER

Figure 1:
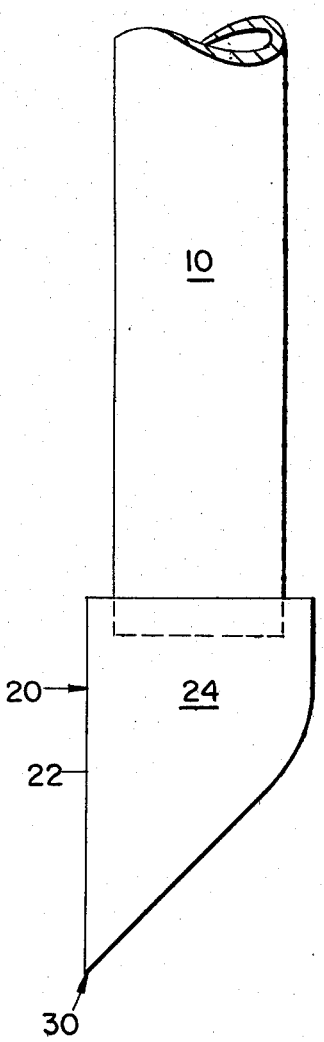

The present invention relates generally to new and useful improvements and structural refinements in tooling for chopping and scraping ice and is directed more particularly to the provision of an ice chopper/scraper having general utility in the arts, and to an improvement in the means for chopping and scraping ice.

It will be helpful to an understanding of my invention first to briefly consider some of the essential points and more important features and aspects thereof, so that same may be kept in mind during subsequent reading of the detailed description of the practical embodiment of my improvements and illustration thereof in the hereunto annexed drawing.

Accordingly, it is first to be noted that my invention envisions a tubular rod or bar serving as a handle or gripping member, at the lower extremity of which there is secured as by a weldment a cutting member having a forward or cutting face disposed tangential to one side of the rod or bar and having arcuate rearwardly projecting supporting faces projecting from each side edge of the forward or cutting face for embracement around and securement to the diamatrically opposite side of the rod or bar.

A primary purpose of the invention is to provide an ice chopping tool which will function more effectively and efficiently than any of the similar devices heretofore known.

Another object is to provide an ice chopper/scraper of the above mentioned type that will give smoothness, ease and precision in handling and operation with a minimum of difficulty and that permits of long continued use with minimum of need for repair or maintenance on the part of the user, all resulting in important distinct advantages in economy of manufacture, ease of operation, reliability of performance, and capability of ready assembly to provide positiveness and ease of manual control and action under the varying conditions of practical use.

These foregoing objects and other incidental ends and advantages will in part be obvious and apparent and will in part be more fully pointed out as the nature of the invention is better understood in the progress of the disclosure below. To the end of attaining these objects and advantages and others hereinafter reasonably appearing, it will be explained that the invention consists substantially in the combination, construction, configuration, location and function of parts, as herein described in detail.

It will be apparent, however, that the physical embodiment delineated, albeit the preferred exemplification, is only indicative of but one of the multiplicity of ways in and purposes for which the principles of the invention may be employed. Same is submitted as a best known embodiment of the invention in accordance with the patent statutes and is given with a view to illustrating and explaining the precise nature of the principles of the invention and their embodiment for practical use, in order that others skilled in the art to which the invention pertains may be enable to adapt and modify them in numerous variations and modifications, each as may be best adapted to the conditions of any particular use.

The objects of the invention are susceptible of attainment by use of constructions different in certain respects from that disclosed, such as minor changes and variations in dimensions, shape, form, proportion, integration, cooperation of material and/or type of subassembly and accessory, all without departing from the underlying principles, salient features, scope and spirit hereof.

Figure 2:
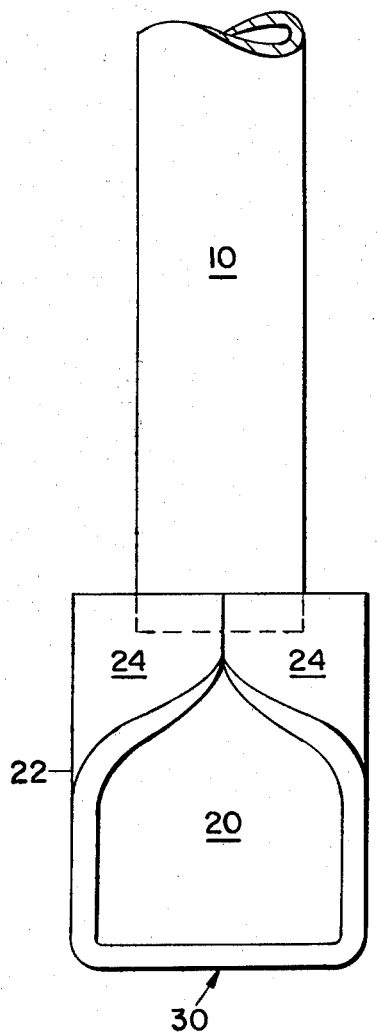
Figure 3:
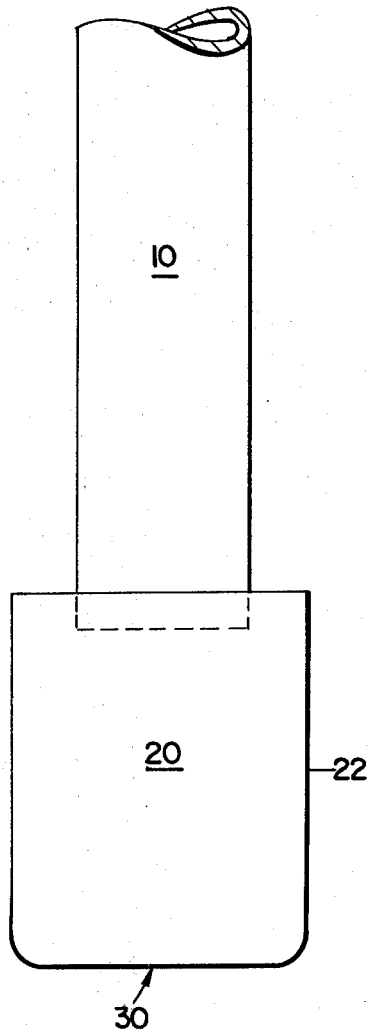
Figure 4:
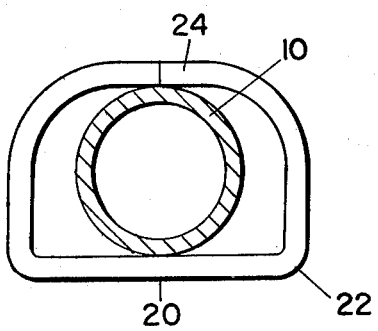

The characteristic features which I consider to be novel with my invention, as to its construction and organization and as to its methods of manufacture and operation, will be better understood from a consideration of the following detailed description forming a part of this specification, when read in conjunction with the illustrations in the accompanying drawing, wherein like characters of reference are employed to designate like or corresponding parts throughout the several views and in which FIGS. 1, 2 and 3 are views in side elevation, rear elevation and front elevation respectively of the tool of the invention; and FIG. 4 is a view in top plan of the tool as shown in FIG. 3.

Referring to the drawings, a handle 10 is shown as being of tubular metal although it could be a solid member and it could conceivably be made of wood although this is hardly recommended because of the hard usage to which the tool would be exposed.

Too the handle can be of any desired weight and strength and of any convenient length.

To the lower end of the handle is secured as by a weldment, not shown, a plate which comprises a straight sided intermediate portion 20 which is more or less square in configuration and projecting rearwardly from each side edge 22 thereof is a supporting portion 24 which is provided with a curvilinear configuration so as to extend not only rearwardly but also inwardly with the end edges of the two supporting portions being brought into osculation with each other.

Each supporting portion 24 is additionally provided with a taper which extends downwardly from its outboard free terminus to its line of joinder with the respective side edge 22 of the intermediate portion 20.

The lowermost or bottom edge 30 intermediate portion 20 may be somewhat sharpened to provide a more sophisticated cutting edge for the tool.

In the cleaning of a walk or path covered with ice and snow, several different types of work have to be performed and the tool hereof lends itself nicely to the successful performance of all of these types.

The lower curvilinear edges of the supporting portions 24 serve as pressure areas in the sense that as the tool is brought vertically downwardly into cutting relation with the ice or frozen mud being operated upon, it pressurizes the ice or mud and forces it forwardly in the direction of the straight sided intermediate portion 20.

Firstly, it is essential that the ice and packed snow be broken up. This is done by chopping with the cutting edge being brought vertically downwardly with requisite force.

Secondly, it is necessary to scrape the ice and snow so broken up for complete separation from the walk or path and the tool lends itself adequately for this purpose.

Thirdly, it is normally requisite that the ice and snow be broken up and so scraped be pushed to one side in the walk or path cleansing program, and here again the tool hereof is found not wanting.

The tool could be made in a variety of sizes to accommodate to different users and different ice situations.

While the exemplification shows a rod or bar of tubular configuration, it is to be understood that same could be made of square or triangular or other configuration.

The protection which is sought for this invention is covered by the language of the above specification and the spirit represented thereby. It should be appreciated that its utility and application extend beyond the particular type of ice chopper/scraper illustrated and its broad scope and concept comprehend the useful and novel features set forth when combined with other instrumentatlities useful in work of the type here contemplated.

The claims are desired to include within the scope thereof all of said suitable variations, modifications and equivalents by which substantially the results of the invention may be obtained through the use of substantially the same or equivalent devices or means. Accordingly, limitation hereof should only be made as determined by a proper interpretation of the prior art and the scope of the subjoined claims, in which it is my intention to claim all novelty inherent herein as broadly as possible.

I therefore particularly point out and distinctly claim as my invention:

1. A tool for chopping and breaking ice comprising, a plate having a straight sided intermediate portion of substantially square configuration having a straight chamferred lower edge for providing the chopping and breaking function, a pair of arcuate supporting portions projecting rearwardly from each side edge of the intermediate portion, the supporting portions having a curvilinear configuration so as to extend not only rearwardly but also inwardly with the end edges of the two supporting portions being brought into osculation with each other, each supporting portion additionally being provided with a taper which extends downwardly from its outboard free terminus to its line of joinder with the respective side edge of the intermediate portion with the lower edges of the arcuate portions serving to pressurize the ice and to force it forwardly in the direction of the straight sided intermediate portion, and a handle disposed between the intermediate portion and the arcuate portions and welded thereto.

* * * * *